United States Patent [19]

Turner et al.

[11] 3,952,192

[45] Apr. 20, 1976

[54] THERMAL SWITCH DEVICE

[75] Inventors: Charlie B. Turner; Clifford M. Laughter, both of Hendersonville, N.C.

[73] Assignee: General Electric Company, New York, N.Y.

[22] Filed: May 27, 1975

[21] Appl. No.: 581,168

[52] U.S. Cl. ..... 250/239; 250/206; 315/159; 337/107

[51] Int. Cl.[2] ..... H01J 5/02

[58] Field of Search ..... 250/206, 239; 337/100, 337/377, 378, 102, 107; 315/159

[56] References Cited

UNITED STATES PATENTS

| | | | |
|---|---|---|---|
| 3,496,422 | 2/1970 | Horowitz | 250/239 X |
| 3,538,379 | 11/1970 | Berlin | 337/102 X |
| 3,579,167 | 5/1971 | Grable | 337/107 X |
| 3,727,063 | 4/1973 | Turner | 250/206 |
| 3,789,220 | 1/1974 | Schacht | 337/102 X |

*Primary Examiner*—Walter Stolwein
*Attorney, Agent, or Firm*—Sidney Greenberg

[57] ABSTRACT

Thermal switch assembly for photoelectric control device to switch loads such as street lighting luminaires on and off in response to ambient light levels. Housing having a portion integral with base of photocontrol unit and having a removable cap contains a bimetal relay assembly and positive temperature co-efficient resistor (PTCR) connected to a photocell for actuating the electrical contacts of the relay assembly.

14 Claims, 6 Drawing Figures

8
21
20
5
26
8
22
27b
18
3
4

26c
26a
26
26b
28
6
23
12
20
25
8
27a
5
24
21
8
22b
22c
22
27b
18
3
4

THERMAL SWITCH DEVICE

The present invention relates to control devices for operating electrical systems such as street lighting equipment in response to ambient conditions, and in particular concerns a thermal switch assembly for lighting control devices.

It is an object of the invention to provide an improved thermal switch device of the above type which is simple in construction, economical to manufacture and reliable in operation.

It is a particular object of the invention to provide a photocontrol device having a thermal switch of the above type.

Other objects and advantages will become apparent from the following description and the appended claims.

With the above objects in view, the present invention in one of its aspects relates to an electrical switch device comprising, in combination, a housing having a bottom wall and a side wall having an open top, a bimetal member covering the open top of the housing, an electrically conductive retainer member overlying the bimetal member, temperature sensitive variable resistance means arranged on the retainer member in electrical and thermal contact therewith, a pair of separable electrical contact members arranged adjacent the bottom wall of the housing including a movable and a fixed contact member, electrically insulating connecting means arranged in the housing between the bimetal member and the movable contact member, and electrically conductive means electrically connecting the retainer member to the fixed contact member, the movable contact member being normally urged in a direction toward the electrically insulating connecting means, the bimetal member flexing in response to variation in temperature to different positions toward and away from the electrically insulating connecting means for thereby operating the movable contact member for electrically connecting and disconnecting the contact members, and a cap covering the open top of the housing and holding the retainer member in assembly on the housing.

The present invention concerns an improvement in the photoelectric control device disclosed in the patent to Turner U.S. Pat. No. 3,727,063 issued Apr. 10, 1973 and assigned to the same assignee as the present invention.

The invention will be better understood from the following description taken in conjunction with the accompanying drawings, in which.

Figure 1:
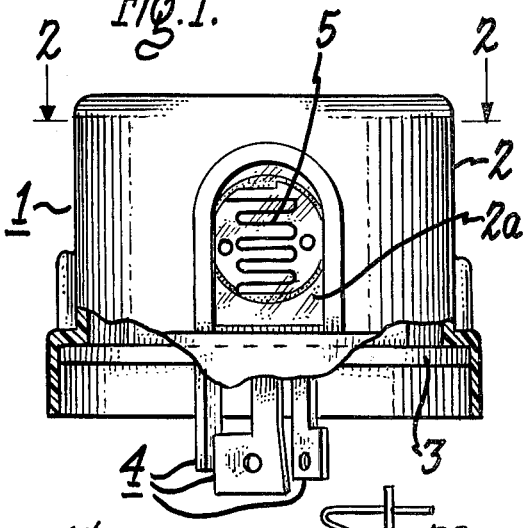
FIG. 1 is an elevational view, partly broken away, of a photocontrol device in which the invention may be embodied.

Referring now to the drawings, and particularly to FIG. 1, there is shown a photoelectric control unit 1 of a type suitable for use with a street lighting luminaire for controlling the operation thereof comprising a casing 2 covering a base 3 having conducting prongs 4 projecting downwardly therefrom for electrical connection in the luminaire (not shown), in a manner well understood in the art. Casing 2 is provided with a window opening 2*a* covered by a transparent member through which light may pass into the casing to strike photocell 5 which has light sensitive material such as cadmium sulfide on its surface.

Figure 2:
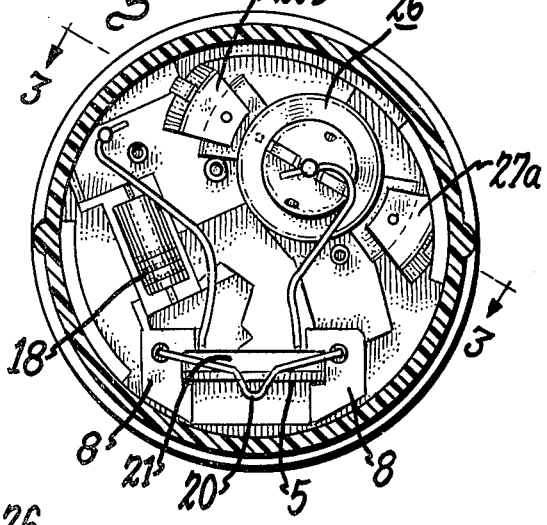
FIG. 2 is a top plan view of the photocontrol device taken along the line of 2—2 of FIG. 1.
Figure 5:
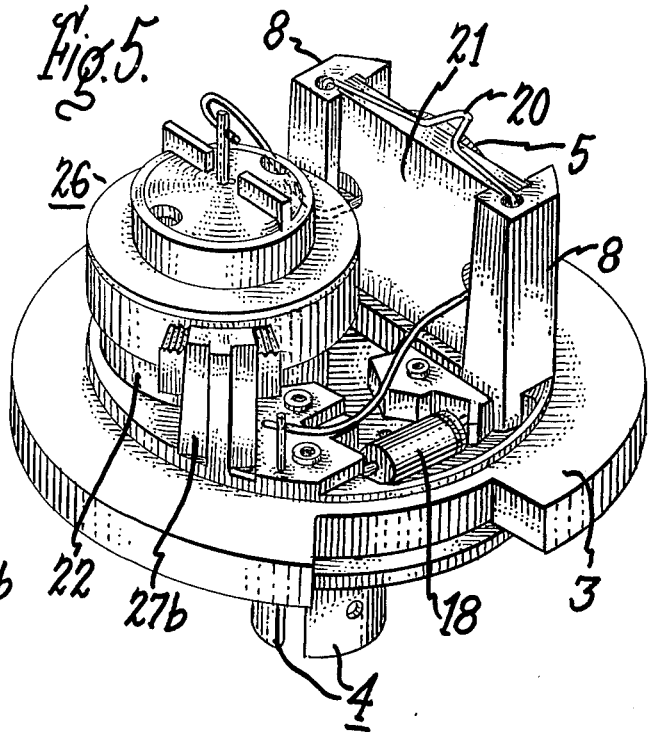
FIG. 5 is a perspective view of the photocontrol device with cover removed.

As seen in FIGS. 2 and 5, the enclosed components of the photocontrol unit include holder 8 formed integral with base 3 and having opposite vertical slots for slidably receiving plate member 21 on which photocell 5 is mounted. Spring 20, having opposite ends inserted into holes in holder 8, retains photocell mounting plate 21 with attached photocell 5 in assembled position. Resistor 18 arranged in an opening in base 3 is suitably secured thereto, and is electrically connected to one of the prongs 4 and to photocell 5 substantially as disclosed in the aforesaid Turner patent, of which the electrical circuit shown therein is incorporated herein by reference.

The thermal switch device employed in accordance with the present invention is mounted in an enclosure comprising a circular housing 22 integral with base 3 and formed with an annular ridge 22*a* surrounding its open top and a central apertured boss 22*b* at its bottom. Base 3 and its integrally formed parts are made of electrically insulating material such as a phenolic resin. Housing 22 is formed inwardly of annular ridge 22*a* with a narrow ledge on which is seated a curved bimetallic disk 12. Overlying bimetallic disk 12 in close proximity thereto is metallic retainer disk 23 which is substantially larger in diameter than bimetallic disk 12 and rests inwardly of its periphery on annular ridge 22*a* as shown. Typically, retainer disk 23 is somewhat dished on its underside to receive the central portion of bimetallic disk 12. Mounted below the housing 22 are switch contacts 9 and 10, of which contact 9 comprises a leaf spring member fixed at one end to base 3 in electrical connection with prong 4a which is to be connected to the lamp load, and contact 10 is fixed to base 3 in electrical connection with prong 4c to be connected to the supply line.

Housing 22 is formed with an elongated aperture 22*c* extending vertically through its side wall in which is received coil spring 24 in electrical contact at its top with retainer disk 23 and at its bottom with line prong 4*c*. Other forms of electrical conductors may be used instead of spring 24, such as a flexible lead wire or other conducting member. Slidably received in the aperture of central boss 22*b* is actuator rod 25 which rests on its bottom end on movable contact 9, with its top end closely adjacent the underside of bimetallic disk 12. Rod 25 is formed of an electrically insulating material such as a ceramic, synthetic resin or glass, preferably having high mechanical strength and good thermal resistance.

Arranged on the top surface of retainer disk 23 is positive temperature co-efficient resistor (PTCR) 6, which is preferably suitably attached to the top surface of retainer disk 23 by solder or by a conductive adhesive material, such as silver-containing epoxy material or other adhesive media having high thermal conductivity and low electrical resistance.

Figure 3:
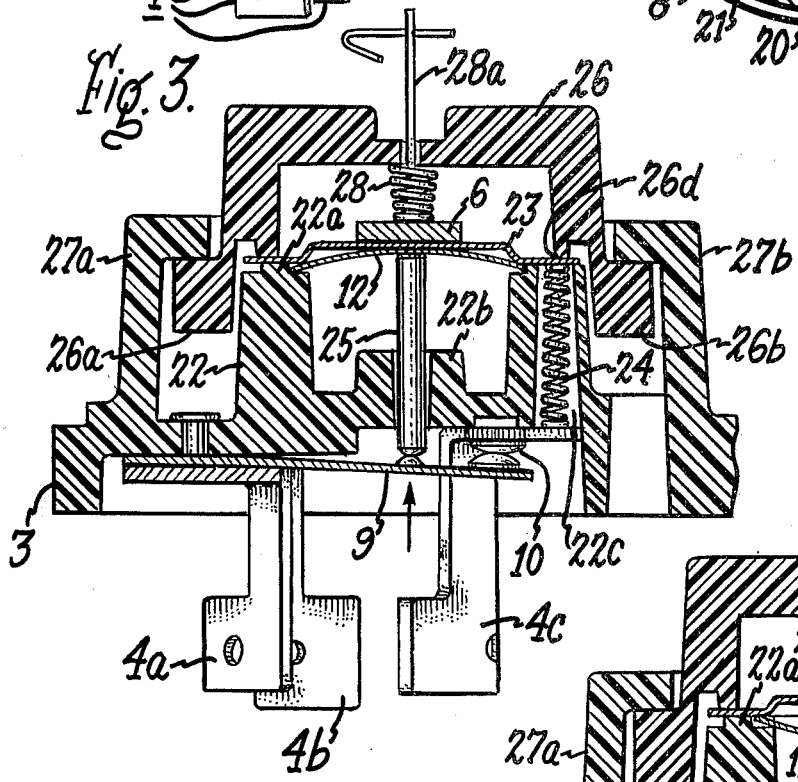
FIG. 3 is a cross-sectional view of the thermal switch device of the photocontrol unit taken along the line 3—3 of FIG. 2.
Figure 6:
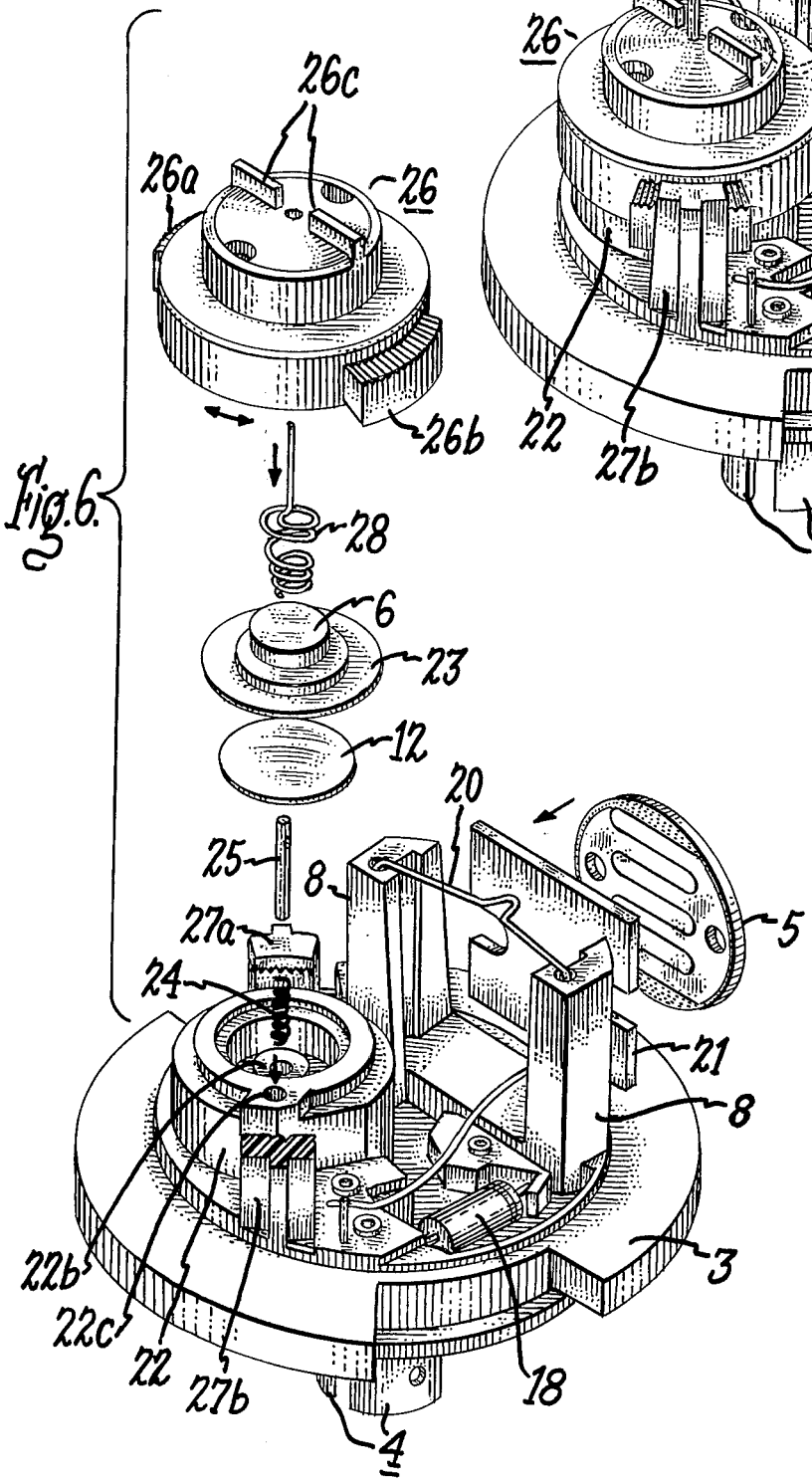
FIG. 6 is an exploded view of the parts of the photocontrol device as shown in FIG. 5.

Covering the top of the described thermal switch device is cap 26 (see FIGS. 3 and 6) having locking teeth 26*a*, 26*b* projecting from opposite sides which engage the undersides of flanged post members 27*a*, 27*b* formed integral with base 3 on opposite sides of switch housing 22. The upper surfaces of locking teeth 26*a*, 26*b* are formed with serrations and are spirally sloped for interengagement with the undersides of the flanges of posts 27*a*, 27*b* which are provided with complementary serrations and slopes, so that cap 26 may be firmly fastened to posts 27*a*, 27*b* as shown in FIG. 3 when teeth 26*a*, 26*b* are rotated into interlocking engagement under the flanges. The interior wall of cap 6 is formed with an annular ledge 26*d* which in the assembly bears on the upper surface of retainer disk 23 at its periphery. Cap 26 is formed with ridges 26*c* on its top surface to facilitate manual fastening of the cap to posts 27*a*, 27*b*. The mating slopes on interlocking teeth 26*a*, 26*b* and the flanges of posts 27*a*, 27*b* are so formed that the tightening operation forces posts 27*a*, 27*b* slightly outwardly so that the resulting tension in the posts holds the parts together in firm engagement.

Arranged between the underside of cap 26 and the top of PTCR 6 is coil spring 28 which at its bottom is in resilient electrical contact with PTCR 6 and at its top has lead wire 28*a* extending outwardly of cap 26 through an aperture thereof for electrical connection to photocell 5.

Figure 4:
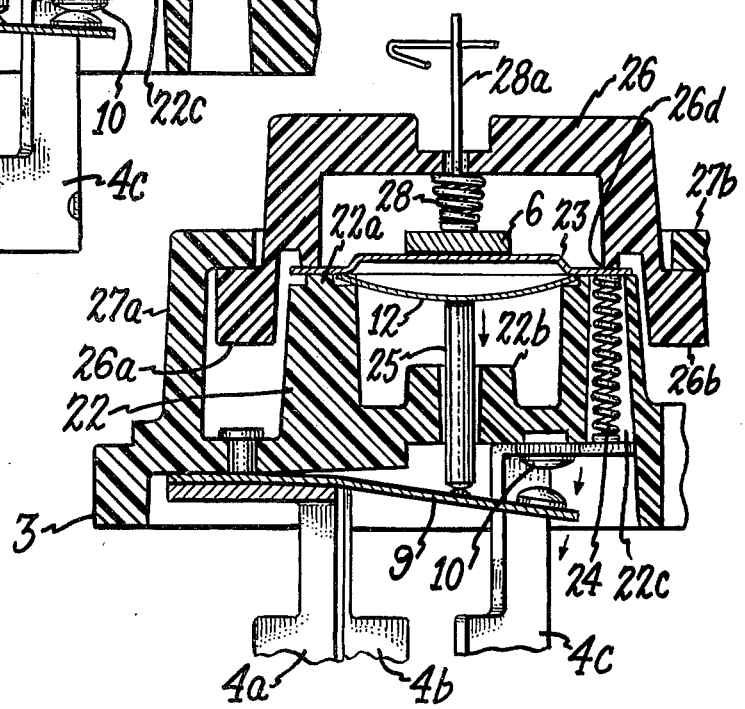
FIG. 4 is a view similar to FIG. 3 showing the thermal switch device in actuated condition with contacts open.

In the operation of the disclosed photocontrol device, current flows through PTCR 6 when ambient light striking photoelectric cell 5 decreases the resistance of the latter. The contacts 9, 10 of the thermal switch are normally closed during the hours of darkness, since during this period the resistance of photoelectric cell 5 is high and little or no current passes through PTCR 6. As the intensity of the light rays increases at dawn, the incidence of such light on photoelectric cell 5 decreases its resistance, with the result that current passes therethrough to PTCR 6. If the thermal switch is at moderate ambient temperature, e.g., 25°C, the resistance of PTCR 6 is relatively low, and the passage of current therethrough will rapidly start heating the PTCR. The lower the ambient temperature, the more rapid is the heating of the PTCR. When the latter reaches a temperature of, say, 100°C, the heat radiated therefrom via retainer disk 23 to bimetallic disk 12 causes the latter disk to flex downwardly to the position shown in FIG. 4, thereby pushing actuator rod 25 against movable contact member 9, moving the latter away from contact 10 and opening the contacts as shown, thereby turning off the luminaire load.

With increased heating, PTCR 6 increases its resistance and thereby limits the current passing therethrough, thus limiting the operating temperature of the thermal switch and associated parts. In a typical case, a thermal equilibrium would be reached at a temperature of, say, 120°C, which is above the actuating temperature of the thermal switch. PTCR 6 in association with the described thermal switch components thus provides a self-correcting constant temperature system which compensates for opposite extremes in ambient temperature conditions, and variations in line voltage. For example, when the circuit is in a hot luminaire, the heating watts contributed by the PTCR are automatically reduced; and, conversely, if the luminaire is subjected to very cold ambient temperature, the heating watts generated by the PTCR are automatically increased and due to its characteristics, results in rapid turn-on of the thermal switch even under severe cold conditions.

At dusk, the reverse process takes place, wherein the resistance of photoelectric cell 5 increases until no actuating current flows to PTCR 6, and bimetal disk 12 then cools off sufficiently to flex upwardly, allowing contacts 9, 10 to close, thereby switching the luminaire load on. Once the thermal switch is closed or opened, its thermal lag or differential is adequate to hold it in that position until a substantial variation in temperature occurs to change its position.

In the described assembly, metal retainer disk 23 provides a number of functions. It constitutes a mounting plate for PTCR 6, it serves as a mechanical support for bimetallic disk 12 when the latter is thermally actuated and snaps downwardly, it acts as a heat radiator for actuating bimetallic disk 12, and it functions as an electrical conductor to transmit current from PTCR 6 to line prong 4*c* via coil spring 24. Retainer disk 23 is typically made of brass or other good electrically conducting material and is preferably tin-plated or otherwise coated with an electrically conductive material to prevent oxidation and thereby afford relatively long life for the switch.

For the purpose of adapting the photocontrol unit for use with higher rated voltages, mounting plate 21 for photoelectric cell 5 may be replaced by a relatively thick metal member (not shown) which would serve as a heat sink to absorb the additional heat developed during operation at the higher voltages.

While the positive temperature co-efficient element has been described herein as a resistor, it will be understood that other forms of devices including semiconductors may provide equivalent function, i.e., generate heat by the passage of current and having a positive temperature coefficient in respect to such characteristic, and accordingly all such devices are contemplated for use in accordance with the invention.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Electrical switch device comprising, in combination, a housing having a bottom wall and a side wall and having an open top, a bimetal member covering the open top of said housing, an electrically conductive retainer member overlying said bimetal member, temperature sensitive variable resistance means arranged on said retainer member in electrical and thermal contact therewith, a pair of separable electrical contact members arranged adjacent said bottom wall of said housing including a movable and a fixed contact member, electrically insulating connecting means arranged in said housing between said bimetal member and said movable contact member, and electrically conductive means electrically connecting said retainer member to one of said contact members, said movable contact member being normally urged toward said electrically insulating connecting means, said bimetal member flexing in response to variation in temperature to different positions toward and away from said electrically insulating connecting means for thereby operating said movable contact member for electrically connecting and disconnecting said contact members, and a cap covering the open top of said housing and holding said retainer member in assembly on said housing.

2. A device as defined in claim 1, said bimetal member comprising a curved disk, said retainer member comprising a metal disk having a diameter greater than said bimetal member.

3. A device as defined in claim 2, said bimetal member being normally convex on its upper surface, said retainer member being dished on its underside for receiving said convex bimetal member.

4. A device as defined in claim 2, said housing formed with an annular ridge surrounding its open top, said retainer member resting inwardly of its periphery on said annular ridge.

5. A device as defined in claim 1, said cap being of inverted cup-shaped form having an interior ledge portion bearing on said retainer member adjacent the periphery thereof.

6. A device as defined in claim 1, including a base for mounting said housing, a pair of upright flanged members extending from said base adjacent opposite sides of said housing, and locking means on said cap coacting with said flanged members for releasably locking said cap to said flanged members.

7. A device as defined in claim 6, said locking means comprising locking teeth projecting radially on opposite sides of said cap, said locking teeth and said flanged members having mating sloped surfaces engagable with one another upon turning of said cap for fastening the latter to said flanged members.

8. A device as defined in claim 7, said mating sloped surfaces being formed with complementary serrations for locking said surfaces together.

9. A device as defined in claim 1, and resilient conductor means arranged on said temperature sensitive variable resistance means and having a portion extending outwardly through said cap.

10. A device as defined in claim 1, said resilient conductor means comprising a coil spring portion held in compressive engagement by said cap against said temperature sensitive variable resistance means.

11. A device as defined in claim 1, said electrically conductive means comprising an elongated coil spring arranged in said housing side wall.

12. A device as defined in claim 1, said housing formed in the interior thereof with a portion arranged above said movable contact member and having a guide aperture formed therein, said electrically insulating connecting means comprising a rod slidably received in said guide aperture.

13. A photoelectric control device comprising, in combination, a base member, photoelectric means mounted on said base member and comprising photosensitive variable resistance means, and a thermal switch device mounted on said base member in electrical connection with said photoelectric means and operating in response to variation in current through said photosensitive variable resistance means, said thermal switch device comprising a device as defined in claim 1.

14. A photoelectric control device comprising, in combination, a base member, photoelectric means mounted on said base member and comprising photosensitive variable resistance means, and a thermal switch device mounted on said base member in electrical connection with said photoelectric means and operating in response to variation in current through said photosensitive variable resistance means, said thermal switch device comprising a device as defined in claim 7.

* * * * *